US010589181B2

(12) United States Patent
Kraus

(10) Patent No.: US 10,589,181 B2
(45) Date of Patent: Mar. 17, 2020

(54) CAR WITH ROTATABLY MOUNTED WHEEL AXLE FOR A FAIRGROUND RIDE AND METHOD FOR CONTROLLING A ROTATABLY MOUNTED WHEEL AXLE OF SUCH A CAR

(71) Applicant: MACK RIDES GMBH & CO. KG, Waldkirch (DE)

(72) Inventor: Michael Kraus, Ehrenkirchen (DE)

(73) Assignee: MAC Rides GmbH & Co. KG, Waldkirch (DE)

( * ) Notice: Subject to any disclaimer, the term of this patent is extended or adjusted under 35 U.S.C. 154(b) by 627 days.

(21) Appl. No.: 15/127,336

(22) PCT Filed: Mar. 24, 2015

(86) PCT No.: PCT/EP2015/056312

§ 371 (c)(1),
(2) Date: Nov. 8, 2017

(87) PCT Pub. No.: WO2015/150172

PCT Pub. Date: Oct. 8, 2015

(65) Prior Publication Data

US 2018/0050274 A1 Feb. 22, 2018

(30) Foreign Application Priority Data

Apr. 2, 2014 (DE) ..... 10 2014 104 636

(51) Int. Cl.
*A63G 21/08* (2006.01)
*A63G 7/00* (2006.01)
*A63G 21/04* (2006.01)

(52) U.S. Cl.
CPC ..... *A63G 21/08* (2013.01); *A63G 7/00* (2013.01); *A63G 21/04* (2013.01)

(58) Field of Classification Search
CPC ..... A63G 7/00; A63G 21/08; A63G 21/20
(Continued)

(56) References Cited

U.S. PATENT DOCUMENTS 1,409,750 A 3/1922 Miller
1,654,670 A 8/1926 Traver
(Continued)

FOREIGN PATENT DOCUMENTS

DE 23 56 156 A1 5/1975
DE 692 03 701 T2 3/1996
(Continued)

OTHER PUBLICATIONS

European Patent Office office action for related application EP 15 712602.0, dated Nov. 19, 2018.
(Continued)

*Primary Examiner* — Zachary L Kuhfuss
(74) *Attorney, Agent, or Firm* — William Gray Mitchell

(57) ABSTRACT

The invention is a car for a fairground ride with at least one axle arranged on a rotatable carrier structure and a coupling element for coupling a further car, wherein the coupling element is movably mounted and connected to the carrier structure via a mechanical operative connection so that a movement of the coupling element leads to a rotation of the carrier structure and of the wheel axle arranged thereon and a rotation of the rotatable carrier structure leads to a movement of the coupling element, and a method for controlling the rotation of a mounted carrier structure of a wheel axle of a car of a fairground ride with a coupling element for a further car, wherein a position change of the relative position of the car in relation to another is translated into a position change of the coupling element.

3 Claims, 4 Drawing Sheets

(58) Field of Classification Search
USPC ..... 104/59, 74, 75
See application file for complete search history.

(56) References Cited

U.S. PATENT DOCUMENTS

| | | | | |
|---|---|---|---|---|
| 3,554,130 | A * | 1/1971 | Broggie | A63G 1/34 104/75 |
| 2017/0120154 | A1* | 5/2017 | Rebbie | B61D 15/00 |
| 2018/0050274 | A1* | 2/2018 | Kraus | A63G 7/00 |

FOREIGN PATENT DOCUMENTS

| | | | |
|---|---|---|---|
| EP | 0 115 355 | A2 | 8/1984 |
| EP | 1 201 280 | A2 | 5/2002 |
| GB | 492 779 | A | 9/1938 |
| GB | 492779 | | 9/1938 |
| JP | 1989-311961 | | 12/1989 |
| JP | H11 114229 | A | 4/1999 |
| JP | 2006-346182 | | 12/2006 |

OTHER PUBLICATIONS

International search report for related application.
Office Action for related application DE 10 2014 104 636.6, dated Sep. 24, 2014.
Japanese Patent Office office action for related application JP 2016-560474, dated Oct. 2, 2018.

* cited by examiner

CAR WITH ROTATABLY MOUNTED WHEEL AXLE FOR A FAIRGROUND RIDE AND METHOD FOR CONTROLLING A ROTATABLY MOUNTED WHEEL AXLE OF SUCH A CAR

CROSS REFERENCE TO RELATED APPLICATIONS

This patent application claims priority International Patent Application PCT/EP2015/056312, filed on Mar. 24, 2015, and thereby to German Patent Application 10 2014 104 636.6, filed on Apr. 2, 2014.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The present invention relates to a car with rotatably mounted wheel axle for a fairground ride and method for controlling a rotatably mounted wheel axle of such a car.

Background of the Invention

Many known fairground rides at carnivals and amusement parks have rail-based vehicles that are composed of intercoupled cars, e.g., a power car and one or more passenger cars, and that run with running wheels along the rails, either on the rails, suspended therefrom, or arranged laterally in relation thereto. In many cases propulsion is achieved by power driven friction wheels, which run on a rail surface. In such cases it is desirable to adjust the orientation of the friction wheels to the direction of travel because this reduces the wear on the friction wheels and the amount of noise produced. The necessary rotational degree of freedom for the friction wheels can be achieved by mounting the friction wheels on a wheel bogie, for example.

A known possibility for such an adjustment of the orientation of the friction wheels to the track layout consists of the motorized control of said wheels, for example by power driving the wheel bogie. However, this requires the provision of an additional drive that must fulfill high demands. Owing to the frequently high speeds of fairground rides, the actuation times must be short, which makes the use of high torque motors compulsory. In addition there is the problem that the target position to be controlled by the drive is dependent on the actual current position on the track stretch, which has to be determined relatively accurately and virtually in real time, which requires an additional measurement or sensor system. Measurement inaccuracies and measurement errors in this measurement could even thwart the purpose of the motorized control if they result in an active actuation of a misalignment of the friction wheels. And last but not least, valuable installation space is taken up by all of these necessary measures.

The problem addressed by the invention is therefore that of finding a possibility for controlling the friction wheels of a car for a fairground ride that can be implemented more easily and more economically than prior art controls.

This problem is solved by a car for a fairground ride with a rotatably mounted wheel axle with the features of claim 1 and by a method for controlling the rotatably mounted wheel axle of such a car with the features of claim 5. Advantageous developments of the invention are the subject matter of the subordinate claims.

BRIEF SUMMARY OF THE INVENTION

In a preferred embodiment, a car (110) for a fairground ride (100), with at least one wheel axle arranged on a rotatable carrier structure (117) and a coupling element (120) for coupling another car (150), characterized in that the coupling element (120) for coupling another car (150) is movably mounted and connected to the rotatable carrier structure (117) via a mechanical operative connection (130) such that a movement of the coupling element (120) leads to a rotation of the rotatable carrier structure (117) and of the wheel axle arranged thereon and a rotation of the rotatable carrier structure (117) leads to a movement of the coupling element (120).

In another preferred embodiment, the car (110) as described herein, characterized in that the coupling element (120) is mounted in a ball joint (118) fastened to the car (110).

In another preferred embodiment, the car (110) as described herein, characterized in that the mechanical operative connection (130) has a first arm (131), one end of which is connected to an end of the coupling element (120) via a first ball joint (132) and the other end of which is connected to a frame (113) of the car (110) via a second ball joint (133) and that the mechanical operative connection (130) has a second arm (135), one end of which is connected to the rotatable carrier structure (117) via a third ball joint (136) and the other end of which is connected to the first arm (131) via a fourth ball joint (138) between the first ball joint (132) and the second ball joint (133).

In another preferred embodiment, the car (110) as described herein, characterized in that the first arm (131) has a length that can be varied during operation.

In another preferred embodiment, a method for controlling the rotation of a rotatably mounted carrier structure (117) (the wheel axle has no influence on the steering) of a fairground ride (100) with a movably mounted coupling element (120) for coupling an additional car (150), wherein a position change, caused by the track geometry, of the relative position of the car (110) of the fairground ride (100) in relation to the other car (150) is translated into a position change of the movably mounted coupling element (120) and the position change of the movably mounted coupling element (120) is transferred via a mechanical operative connection (130) to a rotation of the rotatable carrier structure (117).

DETAILED DESCRIPTION OF THE INVENTION

Figure 1:
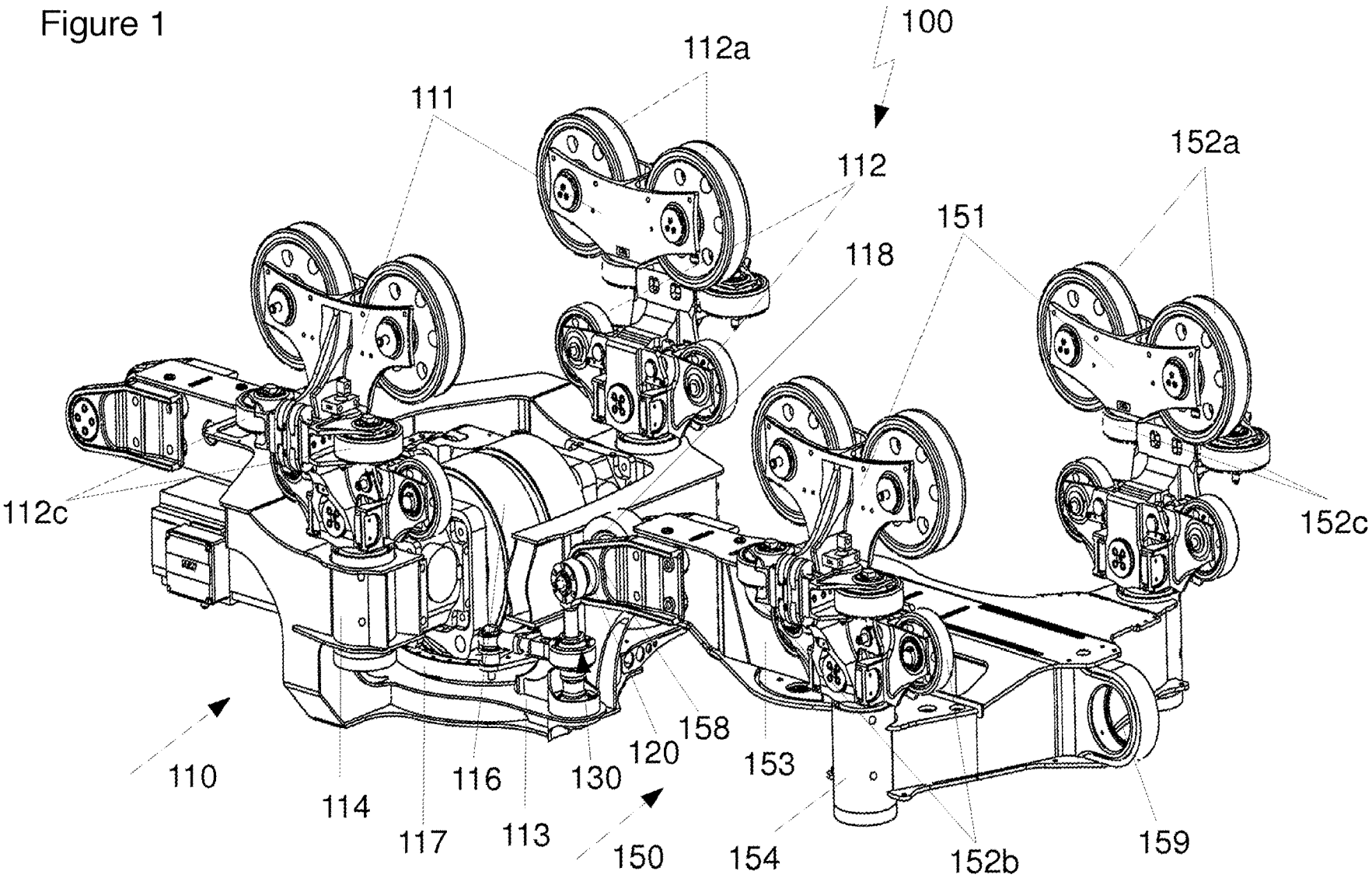
FIG. 1 is a line drawing evidencing a rail-based fairground ride with a power car and a passenger car coupled to the power car.

The car according to the invention for a fairground ride has at least one wheel axle arranged on a rotatable carrier structure and a coupling element for coupling additional cars. The coupling element for coupling additional cars being movably mounted and connected via a mechanical operative connection to the rotatable carrier structure such that a movement of the coupling element leads to a rotation of the rotatable carrier structure and of the wheel axle arranged thereon, and a rotation of the rotatable carrier structure leads to a movement of the coupling element, is essential to the invention. The rotatably mounted wheel axle can be, for example, the axle about which the power-driven friction wheels, which provide the propulsion for the fairground ride, turn. This axle can be rotatably mounted on, for example, a wheel bogie that is rotatable about an axis of rotation that is perpendicular to the layout of the track.

The invention is based on the finding that the relative position of the individual cars of a fairground ride in relation to each other at a given location of a rail-based fairground ride is characterized by the layout of the track at this location, hence a change of this relative position of the cars in relation to each other during the ride can be exploited by means of a mechanical operative connection in order to adjust the orientation of the rotatable carrier structure to the track layout.

If the coupling element is movably mounted on the car such that the position of the coupling element is changed by a change of the relative position of the intercoupled cars in relation to each other, then the position of the coupling element represents information on the local layout of the track at this location, which can be translated via the mechanical operative connection into a rotation of the rotatable carrier structure.

The movable bearing can be concretely configured such that, for example, the coupling element is mounted in a ball joint fastened to the car. In one possible embodiment, the coupling element can be, for example, a coupling rod that, in order to couple to the next car, is either gripped by the coupling mechanism thereof or is inserted through openings in the coupling mechanism thereof. Such a coupling rod can then be mounted centrically in a ball joint, for example.

The special suitability of a ball joint as a bearing becomes clear if the possible changes of the relative positions of cars in relation to each other are visualized.

Negotiating a curve on a level track section leads to a tilting of the coupling rod in a plane parallel to the track plane. In other words, one end of the coupling rod will be displaced forward in the direction of travel, whereas the other end of the coupling rod will be displaced backward against the direction of travel. If this displacement is transmitted via the mechanical operative connection to the rotatable carrier structure and to the wheel axle and, for example, introduced eccentrically to the axis of rotation thereof into the rotatable carrier structure, it effects a rotation of the rotatable carrier structure, which can be used for adjusting the running direction of the wheel axle mounted on the rotatable carrier structure. The extent of this control movement can be adjusted to the requirements of the individual case by the concrete design of the mechanical operative connection.

The mechanical operative connection can be concretely configured such that, for example, it has a first arm, one end of which is connected to an end of the coupling element via a first ball joint and the other end of which is connected to a frame of the car via a second ball joint, and such that it has a second arm, one end of which is connected to the rotatable carrier structure via a third ball joint and the other end of which is connected to the first arm via a fourth ball joint between the first ball joint and the second ball joint.

This construction results in the first arm pivoting in the second ball joint in response to a tilting of the movably mounted coupling element in a plane parallel to the track plane. The end of the first arm mounted in the frame thus remains stationary, whereas the [other end] is displaced to the same extent as the coupling rod in the direction of travel or against the direction of travel via the first ball joint when negotiating a curve.

As a result of this, the extent of the movement transferred via the second arm to the rotatable carrier structure can be influenced through the selection of the position of the fourth ball joint on the first arm between the second ball joint, where a minimum position change takes places in reaction to the position change of the movably mounted coupling element induced by negotiating a curve, and the first ball joint, where a maximum position change takes places in reaction to the position change of the movably mounted coupling element induced by negotiating a curve.

A second parameter that can be used for influencing the transfer of the movement via the mechanical operative connection to the rotatable carrier structure and the reaction thereof to the movement of the movably mounted coupling element is the selection of the bearing point at which the third ball joint is connected to the rotatable carrier structure. The distance of this point from the axis of rotation of the rotatable carrier structure influences the extent of the rotation and the torque with which this rotation takes place. At large distances, a given displacement leads to a smaller rotational movement with a higher torque than at small distances.

Yet another degree of freedom with which the transfer characteristics of the mechanical operative connection can be adjusted is the point on the frame of the car at which the second ball joint is mounted.

However, the track layout for many rail-based fairground rides is not limited to negotiating curves in one plane. In fact the tracks are often designed such that their plane is not fixed in space. Such track sections lead to a torsional degree of freedom within a train of intercoupled cars traveling on them, in other words to a tilting of the cars about an axis running essentially in the direction of travel of the train, which leads to the coupling element moving toward the track with one end and away from the track with the other end.

While this movement of the coupling element can be implemented with a mounting of said coupling element in a ball joint, it is advantageous to provide a possibility for the complete or at least partial decoupling of the mechanical operative connection from this freedom of movement, because as a rule this movement should not be translated into a rotational movement of the rotatable carrier element. This can be achieved by the first arm having a variable length when in operation.

For the concrete implementation of this feature, the first arm can have, for example, a piston that is mounted on the first ball joint and a hollow cylinder, in which a section of the piston is guided and which is mounted on the second ball joint. With this construction, a movement of the coupling element toward the track or away from the track leads to a change of the length of the section of the piston held in the hollow cylinder and is thus largely compensated. However, the fourth ball joint is expediently arranged on the section of the first arm formed by the hollow cylinder in this design.

With the method according to the invention for controlling the rotation of a rotatably mounted carrier structure of a wheel axle of a car of a fairground ride with a movably mounted coupling element for coupling an additional car, a change caused by the track geometry of the relative position of the car of the fairground ride in relation to the other car is translated into a position change of the movably mounted coupling element and the position change of the movably mounted coupling element is translated via a mechanical operative connection into a rotation of the rotatable carrier structure.

In this manner the information about the local track geometry needed for controlling the rotational movement of the rotatable or rotatably mounted carrier structure is obtained from the change of the relative position of train cars in relation to each other induced by the local track geometry, which precipitates in a change of the position of the coupling element, and this position change is exploited via the mechanical operative connection as a drive means for the controlled actuation of the rotational movement to the desired extent.

DETAILED DESCRIPTION OF THE FIGURES

FIG. 1 shows a fairground ride configured as a rail-based fairground ride 100, with a power car 110 and a passenger car 150 coupled to the power car 110. The fairground ride is specifically an inverted powered coaster, in which the cars, in particular the power car 110 and the passenger car 150, with the rotatably mounted undercarriages 111, 151 with running wheels 112*a*, 112*b*, 112*c*, 152*a*, 152*b*, 152*c*, are suspended on a (not illustrated) track system such that the running wheels 112*a*, 112*b*, 112*c* and/or 152*a*, 152*b*, 152*c* each grip a track section.

The passenger car 150 has a frame 153 on which the undercarriages 151 with running wheels 152*a*, 152*b*, 152*c* are rotatably mounted in bearings 154. Also mounted on the frame 153 are the not illustrated super structures and/or attachments, in particular a carrier structure for the passenger seats, on which safety bars for securing passengers sitting in the passenger seats during the ride can also be arranged, as well as any theme-related attachments for adapting the outer appearance of the fairground ride to a specific theme. A coupling element 158 is arranged on the end of the passenger car 150 facing the power car 110, via which element the passenger car 150 is coupled to the power car 110. Another coupling element 159, to which additional (not illustrated) passenger cars 150 can be coupled, is arranged on the end of the passenger car 150 opposite this end.

The power car 110 has a frame 113 on which the undercarriages 111 with the running wheels 112*a*, 112*b*, 112*c* are rotatably mounted in bearings 114. The frame 113 furthermore carries the not illustrated drive, which in particular powers two friction wheels 116 that are arranged on an axle arranged on a rotatable carrier structure 117 configured as a wheel bogie. When the fairground ride 100 is in operation, the propulsion is generated by the friction wheels 116 interacting with a running surface of the not illustrated track system and thus moving the power car 110 with the passenger cars 150 coupled thereto forward.

In addition, a coupling element 120 in the form of a coupling rod is mounted in a ball joint 118 at the back end of the power car, which rod is inserted through holes in the coupling element 158 of the passenger car 150, the middle section of said rod being mounted in the ball joint 118. An end section of the coupling element 120 is connected to the wheel bogie 117 via a mechanical operative connection 130, which is mounted by one end in a bearing 134 arranged on the frame 113.

Referring to FIG. 1, it is easy to envision how the position of the coupling element 120 mounted in the ball joint 118 is influenced by a change caused by the track layout in the relative position of the power car 110 in relation to the passenger car 150. When negotiating a curve, one end of the coupling element 120 is moved forward, toward the drive 115, and the other end of the coupling element 120 is moved backward, toward the passenger car 150. A twist of the track system leads to an upward movement of one end of the coupling element 120, toward the not illustrated rail system (because the ride is an inverted coaster, whereas in a fairground ride traveling on top of the track system, up would obviously be the direction away from the rail system) and to a downward movement of the other end of the coupling element 120, away from the not illustrated rail system (again because the illustrated example is an inverted coaster). Because the coupling element 120 is mounted in the ball joint 118, these movements can also be superimposed.

These movements of the coupling element 120 configured as a coupling rod are at least partially translated via the mechanical operative coupling 130 into rotational movements of the wheel bogie 117 and as a result the running direction of the friction wheels 116 is adapted to the local track geometry.

Figure 2:
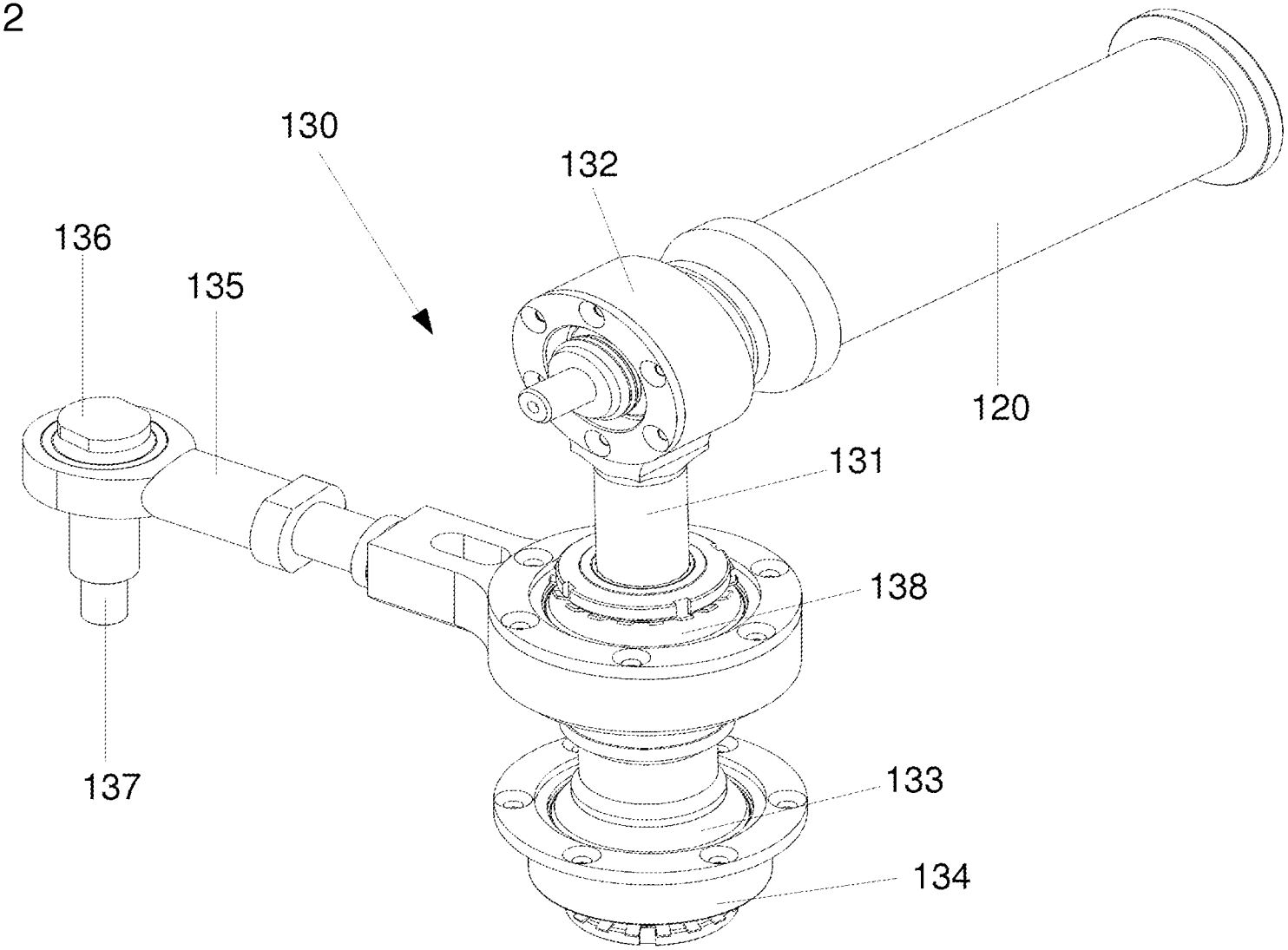
FIG. 2 is a line drawing evidencing a three-dimensional illustration of a mechanical operative connection.

An exemplary design for the mechanical operative connection 130 will now be described with reference to FIGS. 2, 3*a*, and 3*b*. As can be discerned from the view according to FIG. 2, the mechanical operative connection 130 has a first arm 131, one end of which is connected to an end of the coupling element 120 via a first ball joint 132 and the other end of which is connected via a second ball joint 133, which is connected via the bearing 134 to the frame 113 of the power car 110. The mechanical operative coupling 130 furthermore has a second arm 135, one end of which is coupled to the rotatable carrier structure in the form of a wheel bogie 117 via a third ball joint 136 and its bearing pin 137 and the other end of which is connected via a fourth ball joint 138 in the region between the first ball joint 132 and the second ball joint 133 to the first arm 131.

Figure 3A:
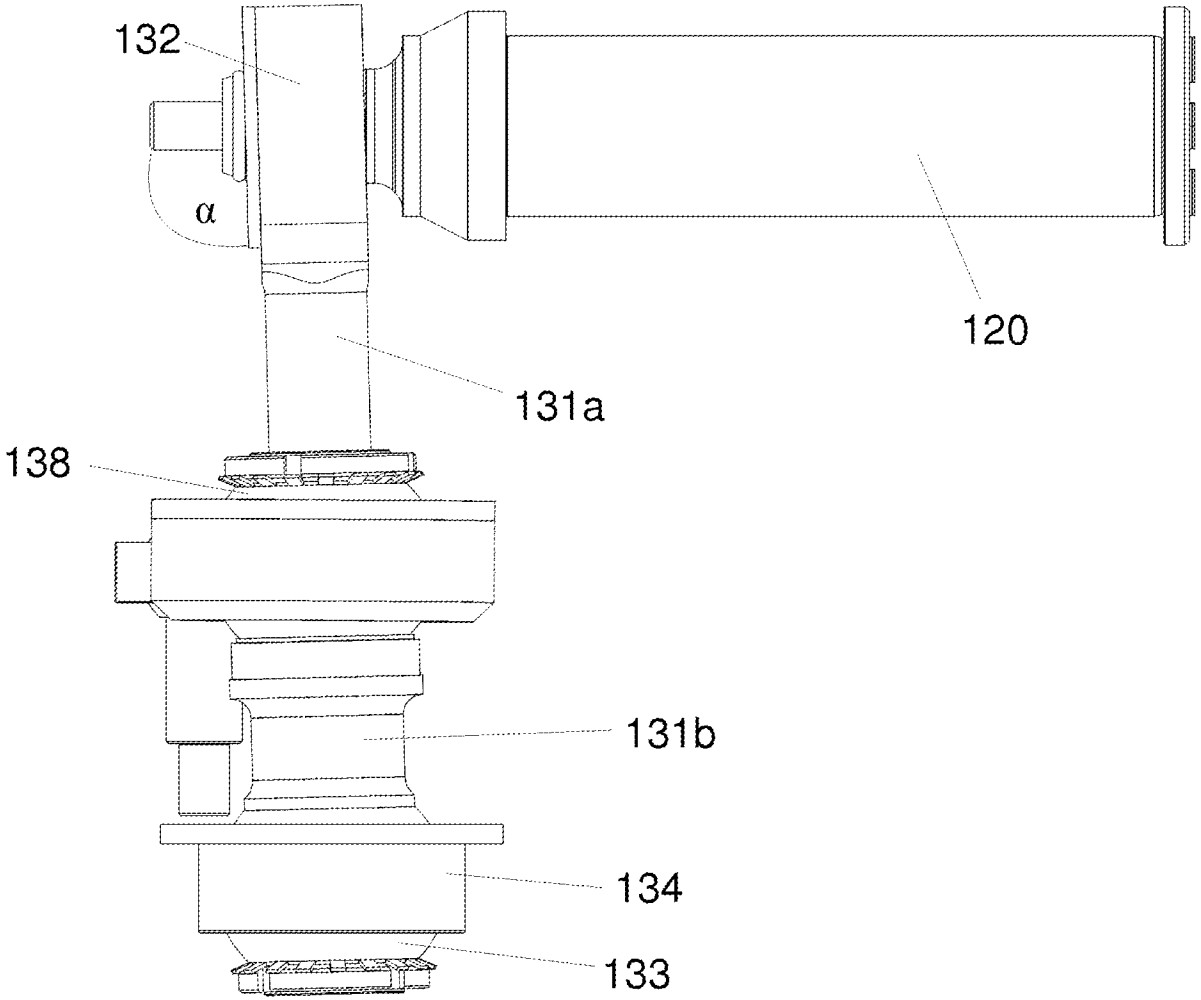
FIG. 3*a* is a line drawing evidencing is a view from above of a coupling rod and a first arm of the mechanical operative connection according to FIG. 2.

By referring to the view from above according to FIG. 3*a*, the movement of the first arm 131 in reaction to a change in the position of the coupling element 120 is readily clarified: When negotiating a curve, the end of the coupling element 120 connected to the first arm 131 moves into the sheet plane of the figure (so that it virtually penetrates the sheet level in the direction away from the observer) or out of the sheet plane of the figure (so that it virtually moves toward the observer). Accordingly, the first ball joint 132 follows this movement, whereas the second ball joint 133 is fixed by the bearing 134. Accordingly, the first arm 131, and the fourth ball joint 138 along with it, hinges around the ball joint 132 out of the sheet plane or into the sheet plane.

In the event of a twist in the track section, the end of the coupling element 120 connected to the first arm 131 moves upward or downward in the representation of the drawing. As a consequence of this movement, the angle α changes, which is possible because the connection between the first arm 131 and the coupling element 120 is formed by a ball joint, namely the first ball joint 132. Furthermore, because the second ball joint 133 is fixed by the bearing 134, the length of the first arm 131 changes, which is made possible by the first arm 131 being composed of a piston 131*a* that is displaceably mounted in a hollow cylinder 131*b*, wherein the fourth ball joint 138 is arranged on the hollow cylinder 131*b* and thus has a fixed distance to the second ball joint 133. Because the coupling element 120 moves along a circular path during the torsional movement, the first arm 131 must also be able to hinge around the bearing 134 in the sheet plane of the figure. However, this second freedom of movement is also possible because of the second ball joint 133.

Figure 3B:
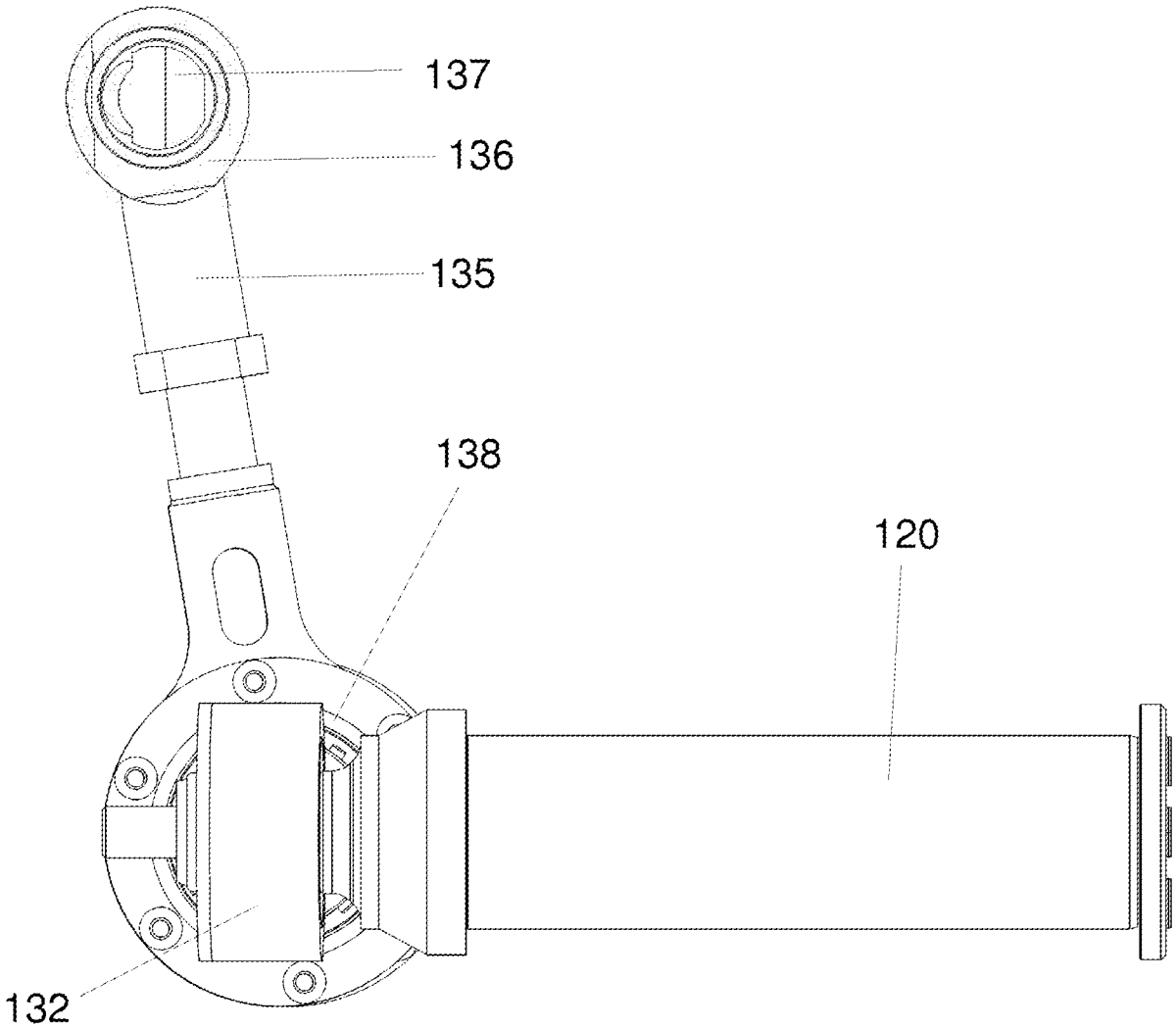
FIG. 3*b* is a line drawing evidencing a view from above of a coupling rod and a second arm of the mechanical operative connection according to FIG. 2.

Referring to the view from above according to FIG. 3*b*, the movements of the second arm 135 and of the bearing pin 137 connected to it via the third ball joint 136 resulting from the corresponding movements of the first arm 131 are readily clarified.

In the event of a torsional movement between the cars, the end of the first arm 131 connected to the coupling element 120 is essentially moved out of the sheet plane of FIG. 3*b* towards the observer or into this sheet plane, i.e., away from the observer. However, the position of the first arm 131 and in particular of the fourth ball joint 138 arranged thereon in the sheet plane is hardly changed at all, because this movement is almost completely compensated by the variation of the portion of the piston 131*a* of the first arm 131 that is held in the hollow cylinder 131*b* of said first arm 131.

During the negotiation of a curve, the end of the first arm 131 connected to the coupling element 120 is essentially moved upward or downward in the image plane of FIG. 3*b*, whereas the second end of the first arm 131 is stationarily fixed in the bearing 134. Accordingly, the first arm 131 with the fourth ball joint 138 arranged thereon executes a hinge motion, which also displaces the fourth ball joint 138 and the end of the second arm 135 arranged thereon upward or downward in the image plane. The second arm 135 remaining in the image plane during this process and not being moved conjointly with the hinge motion of the first arm 131 is made possible by the provision of the fourth ball joint 138 and of the third ball joint 136, which create this freedom of movement of the second arm 135.

Because the other end of the second arm 135 is fixed via the third ball joint 136 and via the bearing pin 137 on the wheel bogie 117 (not illustrated in FIG. 3*b*), a torque is exerted on the wheel bogie 117, which turns it about its axis of rotation and thus adjusts the orientation of the friction wheels 116 (not illustrated in FIG. 3*b*) to the local track layout.

Because the position of the bearing pin 137 moves along a circular path during the rotational movement of the wheel bogie in the manner just described, a freedom of movement that allows a rotation of the second arm 136 relative to the bearing pin 137 or relative to the first arm 131 in the image plane is also necessary. This is also provided by the third ball joint 136 and the fourth ball joint 138, respectively.

LIST OF REFERENCE NUMBERS

100 rail-based fairground ride
110 power car
111 undercarriage
112*a, b, c* running wheels
113 frame
114 bearing
116 friction wheels
117 rotatable carrier structure
118 ball joint
120 coupling element
130 mechanical operative connection
131 first arm
131*a* piston
131*b* hollow cylinder
132 first ball joint
133 second ball joint
134 bearing
135 second arm
136 third ball joint
137 bearing pin
138 fourth ball joint
150 passenger car
151 undercarriage
152*a, b, c* running wheels
153 frame
154 bearing The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A car for a fairground ride, with at least one wheel axle arranged on a rotatable carrier structure and a coupling element for coupling another car, wherein the coupling element for coupling another car is movably mounted and connected to the rotatable carrier structure via a mechanical operative connection such that a movement of the coupling element leads to a rotation of the rotatable carrier structure and of the wheel axle arranged thereon and a rotation of the rotatable carrier structure leads to a movement of the coupling element, wherein the coupling element is mounted in a ball joint fastened to the car and the mechanical operative connection has a first arm, one end of which is connected to an end of the coupling element via a first ball joint and the other end of which is connected to a frame of the car via a second ball joint and that the mechanical operative connection has a second arm, one end of which is connected to the rotatable carrier structure via a third ball joint and the other end of which is connected to the first arm via a fourth ball joint between the first ball joint and the second ball joint.

2. The car according to claim 1, wherein the first arm has a length that can be varied during operation.

3. A method for controlling the rotation of a rotatably mounted carrier structure (the wheel axle has no influence on the steering) of a fairground ride with a movably mounted coupling element for coupling an additional car, wherein a position change, caused by the track geometry, of the relative position of a first car of the fairground ride in relation to a second car is translated into a position change of the movably mounted coupling element and the position change of the movably mounted coupling element is transferred via a mechanical operative connection to a rotation of the rotatable carrier structure, wherein the coupling element is mounted in a ball joint fastened to the first car and the mechanical operative connection has a first arm, one end of which is connected to an end of the coupling element via a first ball joint and the other end of which is connected to a frame of the first car via a second ball joint and that the mechanical operative connection has a second arm, one end of which is connected to the rotatable carrier structure via a third ball joint and the other end of which is connected to the first arm via a fourth ball joint between the first ball joint and the second ball joint.

* * * * *